US006886926B2

(12) United States Patent
Kaga et al.

(10) Patent No.: US 6,886,926 B2
(45) Date of Patent: May 3, 2005

(54) INK-JET PRINTER WITH INK PATH AND METHOD OF FORMING THE INK PATH

(75) Inventors: Hikaru Kaga, Aichi-ken (JP); Takamasa Usui, Ogaki (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 9 days.

(21) Appl. No.: 10/229,348

(22) Filed: Aug. 28, 2002

(65) Prior Publication Data

US 2003/0048336 A1 Mar. 13, 2003

(30) Foreign Application Priority Data

| | | |
|---|---|---|
| Sep. 11, 2001 | (JP) | 2001-274925 |
| Sep. 11, 2001 | (JP) | 2001-274926 |
| Sep. 11, 2001 | (JP) | 2001-274927 |
| Sep. 11, 2001 | (JP) | 2001-274928 |
| Sep. 17, 2001 | (JP) | 2001-281071 |

(51) Int. Cl.[7] ..... B41J 2/175
(52) U.S. Cl. ..... 347/85
(58) Field of Search ..... 347/84, 85, 86, 347/87; 422/68.1; 138/137, 140, 141

(56) References Cited

U.S. PATENT DOCUMENTS

| | | | | |
|---|---|---|---|---|
| 5,815,182 A | * | 9/1998 | Otis et al. | 347/85 |
| 5,988,801 A | | 11/1999 | Coiner | |
| 5,997,818 A | * | 12/1999 | Hacker et al. | 422/68.1 |
| 6,557,987 B1 | * | 5/2003 | Shibata et al. | 347/84 |

FOREIGN PATENT DOCUMENTS

| | | | |
|---|---|---|---|
| JP | B2 2563784 | 9/1996 | |
| JP | 09-300652 | * 11/1997 | B41J/2/175 |

* cited by examiner

*Primary Examiner*—Anh T. N. Vo
(74) *Attorney, Agent, or Firm*—Oliff & Berridge, PLC

(57) ABSTRACT

An ink path through which ink is delivered from an ink source to a printhead unit includes an ink tube and a joint. The ink tube has a first layer formed of a material with low vapor and gas permeability and a second layer radially thicker than the first layer and formed of a flexible material. The joint has a maximum-diameter portion whose outer diameter is larger than an inner diameter of the ink tube. The joint is inserted into the ink tube. Further, a locking member is fitted over the ink tube. The locking member has an inner-diameter portion whose inner diameter is smaller than an outer diameter of a connection between the maximum-diameter portion of the joint and the ink tube.

35 Claims, 15 Drawing Sheets

INK-JET PRINTER WITH INK PATH AND METHOD OF FORMING THE INK PATH

BACKGROUND OF THE INVENTION

1. Field of Invention

The invention relates to an ink-jet printer and, more particularly, to an ink-jet printer having an ink path formed by ink path forming members that are securely, hermetically interconnected. The invention also relates to a method of forming such an ink path.

2. Description of Related Art

Ink-jet printers that incorporate an ink supply system using a tube are known. Such ink-jet printers have a printhead that ejects ink onto a printing medium, a carriage on which the printhead is mounted, an ink tank that is installed external to the carriage to store ink, and a tube through which ink is supplied from the ink tank to the printhead. One end of the tube is connected to the stationary ink tank, while the other end of the tube is connected to the printhead that reciprocates together with the carriage along a printing medium. Typically, the tube is connected to the printhead frictionally by inserting a joint member of the printhead into the tube.

However, a problem arises in the connection between the tube and the joint member when the printhead repeatedly reciprocates. If the tube moves randomly as the printhead reciprocates, the tube may be loosened or detached from the joint member to permit the entry of air into the ink path. Accumulation of air bubbles in the ink path may lead to a clogging of the ink path and an ink ejection failure.

The tube used for the above-described ink supplying system is typically formed of materials with low vapor and gas permeability, such as polyethylene (PE) and polypropylene (PP), to prevent evaporation of moisture contained in the ink and air permeation through the tube. Compared to tubes formed of flexible materials, such as ethylene rubber and butadiene rubber, the tube formed of the above-described materials, which are generally hard, makes poor contact with the joint member thereby permitting entry of air to the ink path through a gap between the tube and the joint member. As a result, the accumulation of air bubbles in the ink path may lead to a clogging of the ink path and an ink ejection failure.

Japanese Patent No. 2563784 is directed to ink path forming members in an ink-jet printer and discloses an air-tight connection between an ink supply tube and a pipe joint of an ink source or an ink receiver. The tube is inserted into an inner recess of the pipe joint, and the interconnected tube and pipe joint are securely locked by a locking member while a sealing member is interposed between the pipe joint and the locking member. Although the disclosed connecting structure provides an air-tight, secure connection between the ink path forming members, it is fairly complex and requires a large number of members.

SUMMARY OF THE INVENTION

The invention addresses the forgoing problems and provides an ink-jet printer having an ink path formed by ink path forming members that are simple in structure yet securely, hermetically interconnected.

One aspect of the invention provides an ink-jet printer that includes a printhead unit ejecting ink onto a printing medium, an ink source external to the printhead unit, and an ink path thorough which ink is delivered from the ink source to the printhead unit. The ink path includes first and second ink path forming members. The first ink path forming member has a head with a maximum-diameter portion and an open end tapered down from the maximum-diameter portion, and a neck extending from the head and having a smaller diameter than the maximum-diameter portion. The second ink path forming member is formed of at least a flexible elastic material and has an inner diameter smaller than the maximum diameter of the first ink path forming member. The head and the neck of the first ink path forming member are inserted into the second ink path forming member, and the second ink path forming member radially expands at the maximum-diameter portion and contracts at the neck of the first ink path forming member.

The second ink path forming member is a double-layer ink tube having a first layer formed of a material with low vapor and gas permeability and a second layer radially thicker than the first layer and formed of the flexible elastic material.

In another aspect of the invention, the ink path further includes a locking member fitted over the second ink forming member and having a first inner-diameter portion whose inner diameter is smaller than an outer diameter of a connection between the maximum-diameter portion of the first ink path forming member and the second ink path forming member. The first inner-diameter portion presses an outer periphery of the second ink path forming member and locks the connection.

Another aspect of the invention provides a method of forming the ink path through which ink is delivered from the ink source to the printhead unit. A filling liquid is first applied to either an outer periphery of the open end of a first ink path forming member or an inner periphery of the second ink path forming member. Then, the first and second ink path forming members are connected to each other by inserting the first ink path forming member into the second ink path forming member while keeping the filling liquid held between the outer periphery of the open end of the first ink path forming member and the inner periphery of the second ink path forming member.

BRIEF DESCRIPTION OF THE DRAWINGS

A preferred embodiment of the invention will be described in detail with reference to the following figures, in which like elements are labeled with like numbers in which.

DETAILED DESCRIPTION OF PREFERRED EMBODIMENTS

One embodiment of the invention will be described with reference to the accompanying drawings.

Figure 1:
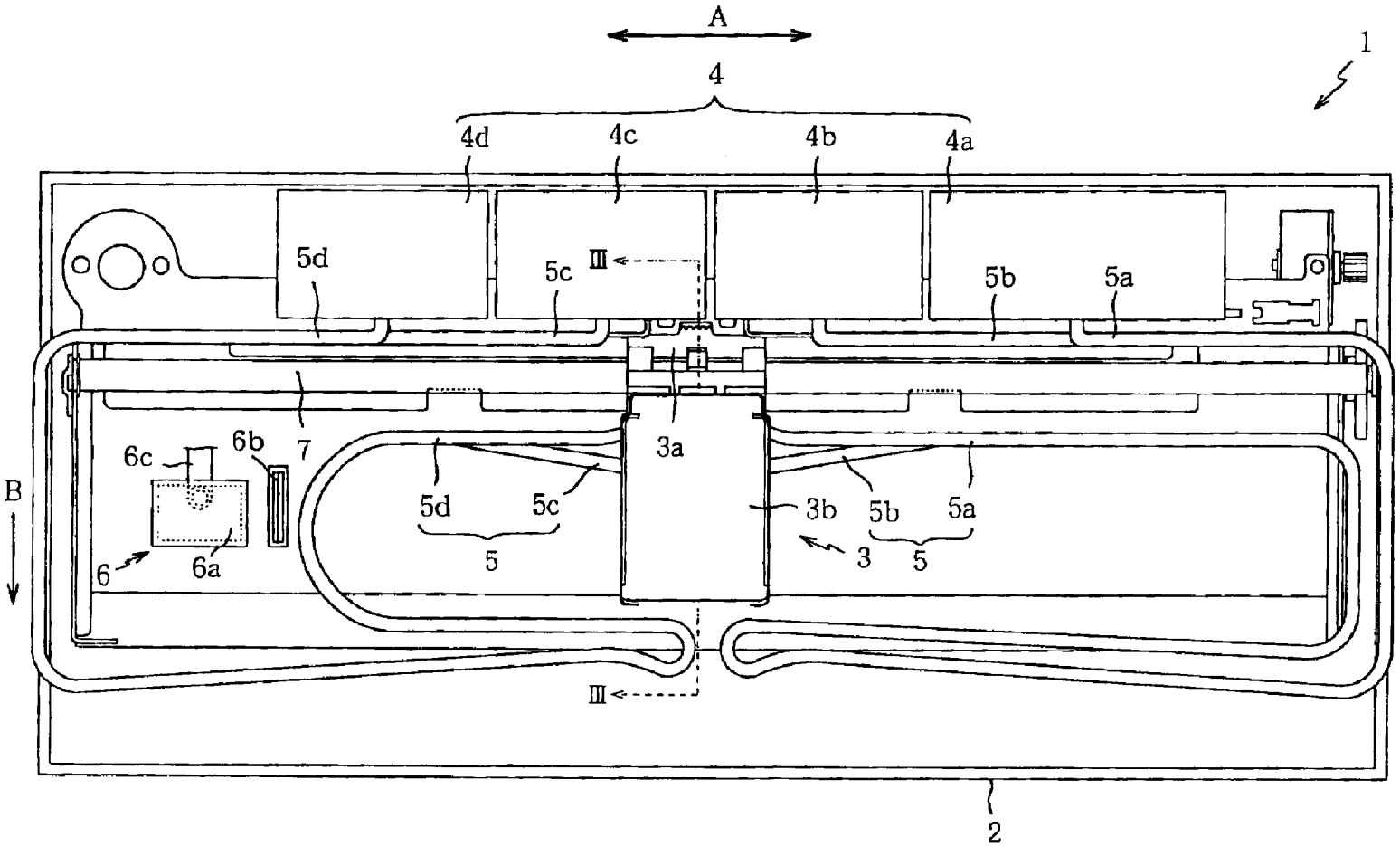
FIG. 1 is a plan view of an ink-jet printer according to one embodiment of the invention.

FIG. 1 is a plan view showing the internal structure of an ink-jet printer 1 according to one embodiment of the invention. The ink-jet printer 1 includes, in its main frame 2, a printhead unit 3 that ejects ink onto a sheet of paper, an ink tank 4 that stores ink to be supplied to the printhead unit 3, tubes 5 through which ink is supplied from the ink tank 4 to the printhead unit 3, a recovery unit 6, and a sheet feeder that feeds sheets of paper.

The main frame 2 is substantially box-shaped and formed of flame-retardant plastic. A guide rod 7 is horizontally disposed in the longitudinal direction of the main frame 2 and supports the printhead unit 3 such that the printhead unit 3 reciprocates in direction A (right and left direction in FIG. 1) perpendicular to the sheet feed direction B.

The printhead unit 3 is substantially box-shaped, and includes a carriage 3*a* and a housing 3*b* continuously formed from the carriage 3*a*. The housing 3*b* houses printheads (not shown), an air trap unit 11 (FIG. 2), and other units.

The carriage 3*a* is fitted onto the guide rod 7 so as to reciprocate thereon. A belt, attached to the carriage 3*a*, is looped over rollers. When a carriage motor, which is connected to one of the rollers, rotates, the belt is driven to move the printhead unit 3.

Feed rollers are provided below the printhead unit 3 to feed a sheet of paper. The feed rollers disposed at the front and rear of the printhead unit 3 feed a sheet of paper in a substantially horizontal direction indicated by arrow B when a feed motor rotates.

A plurality of printheads, for example, four printheads are provided side by side in the printhead unit 3 to perform full-color printing, with their ink nozzles facing down and open toward the sheet side. The printheads receive ink from the air trap unit 11, which will be described later, and distribute ink to ink chambers provided for corresponding ink nozzles. Then, ink is ejected through the ink nozzles by the action of actuators, such as piezoelectric elements. The printheads are supported by the lower surface of the housing 3*b*.

The ink tank 4, disposed below the sheet feed path, stores ink to be supplied to the printhead unit 3. The ink tank 4 consists of four ink tanks 4*a*–4*d* that hermetically contain black, yellow, cyan, and magenta inks, respectively. The ink tanks 4*a*–4*d* are connected to the corresponding printheads through the corresponding tubes 5*a*–5*d*.

The recovery unit 6, disposed on the left side of the main frame 2, performs a recovery operation for the printheads to restore the printheads to a normal ejection state. The recovery unit 6 includes a suction cap 6*a*, a suction pump (not shown) that sucks ink from the printhead unit 3 through the suction cap 6*a*, and a wiper 6*b* that wipes the ink nozzle surface of the printhead unit 3.

The suction cap 6*a* is substantially box-shaped and makes contact with and hermetically covers the ink nozzle surface. A discharge tube 6*c* is connected to the bottom of the suction cap 6*a*. Ink is sucked from the suction cap 6*a* by the action of the suction pump, and flows out through the discharge tube 6*c*. When the suction is completed, the suction cap 6*a* moves away from the ink nozzle surface, and the wiper 6*b*, formed by a rubber plate, wipes the ink nozzle surface smeared with ink. With that, the recovery treatment is completed.

Figure 2:
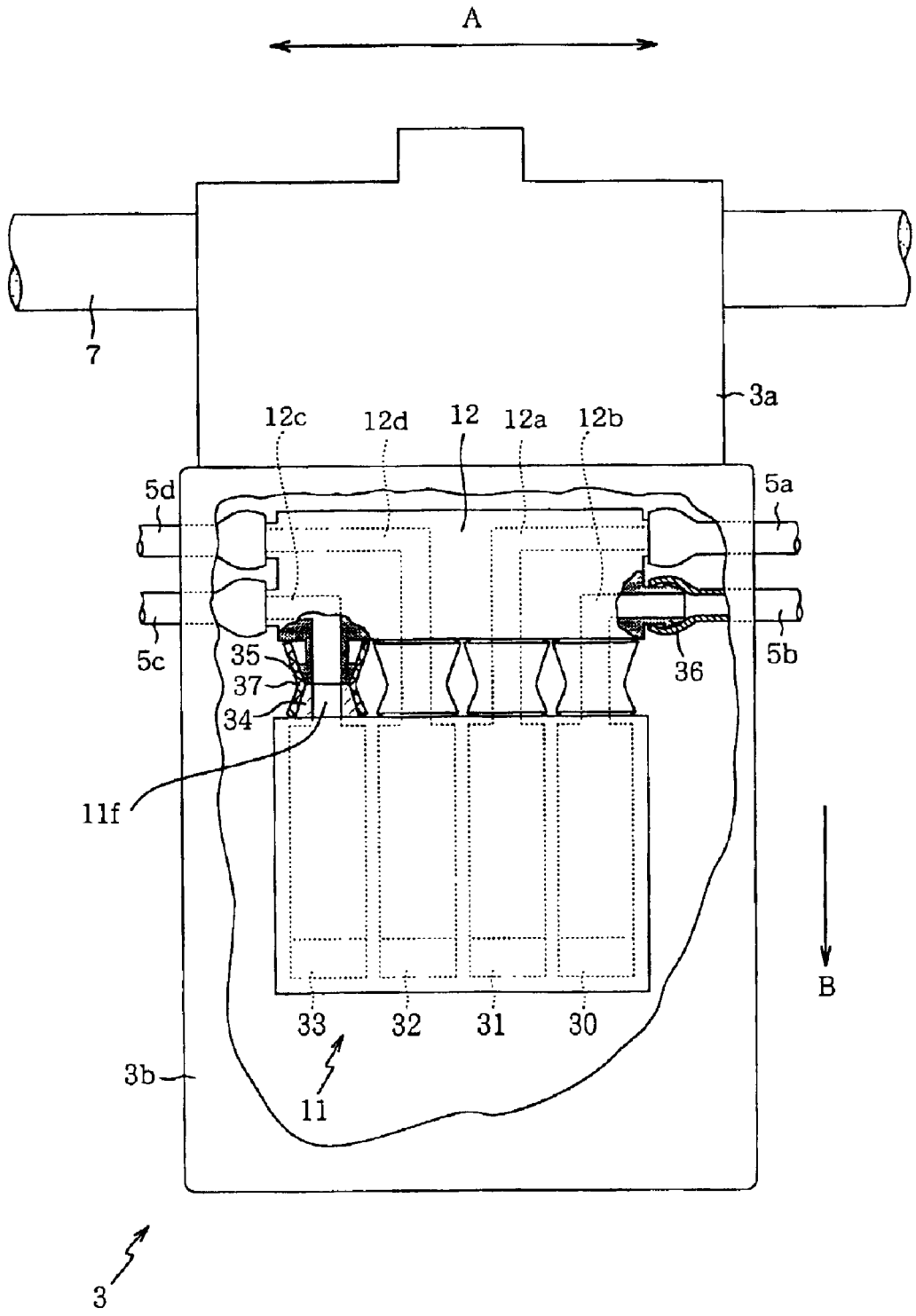
FIG. 2 is a plan view of a printhead unit of the ink-jet printer.

Referring now to FIG. 2, the internal structure of the printhead unit 3 will be described. FIG. 2 is a plan view of the printhead unit 3. The printhead unit 3 contains the air trap unit 11 and a joint unit 12.

The air trap unit 11 traps air bubbles generated in the tubes 5. The air trap unit 11 is shaped like a rectangular solid and disposed in the middle of the housing 3*b* of the printhead unit 3. The air trap unit 11 is divided into four separate air traps 30–33 that correspond to the four printheads disposed below the air traps 30–33. At the rear sides (top side in FIG. 2) of the air traps 30–33, four joints 34 are provided substantially in a row so as to be connected to the joint unit 12. The joints 34 are tapered down toward the joint unit 12 and each joint 34 has, in its inside, an ink inlet 11*f* for a corresponding one of the air traps 30–33.

The joint unit 12 is provided to connect tubes 5*a*–5*d* to the corresponding air traps 30–33. The joint unit 12 is shaped like a rectangular solid and disposed behind the air trap unit 11 (above the air trap unit 11 in FIG. 2). The joint unit 12 has four separate ink paths 12*a*–12*d*. At both ends of each ink path 12*a*–12*d*, a first joint 35 and a second joint 36 are provided in a protruding manner so as to be connected to the corresponding air trap 30–33 and tube 5*a*–5*d*.

The first joints 35 are arranged substantially in a row on a surface of the joint unit 12 and face the joints 34 of the air traps 30–33. Each first joint 35 has a neck projecting from the body of the joint unit 12 and a head radially extending from the neck and tapered down toward the corresponding joint 34. Each first joint 35 and the corresponding joint 34 are inserted into a connecting member 37 from its opposite ends, and thereby connected to each other. The first joints 35 and the joints 34 are formed of a relatively inflexible material, such as polypropylene or other hard plastics. Connections between the joints 34 and the first joints 35 will be described later in detail with reference to FIGS. 3 and 4.

The second joints 36 are provided for the joint unit 12, two for each of the right and left sides of the joint unit 12. Each second joint 36 has a neck projecting from the body of the joint unit 12 and a head radially extending from the neck and tapered down toward the corresponding tube 5*a*–5*d*. Each second joint 36 is inserted into one end of the corresponding tube 5*a*–5*d*, and thereby connected to the corresponding tube 5*a*–5*d*. The second joints 36 are formed of a relatively inflexible material, such as polypropylene or other hard plastics. Connections between the second joints 36 and the tubes 5*a*–5*d* will be described later in detail with reference to FIGS. 7–14.

FIGS. 3–4, and 8–10 show various structures designed to prevent troubles caused by air bubbles in the ink path formed between the tube 5 and the air trap unit 11. If any gap, created by two ink forming members (joints), is not filled with ink and an air bubble remains there, very small bubbles dissolved in the ink will gather around the remaining air bubble to grow into a large air bubble. The large air bubble can possibly narrow or clog the narrow ink path and cause a poor ink supply and/or an ink ejection failure. The structures to be described are designed to prevent such failures.

Figure 3:
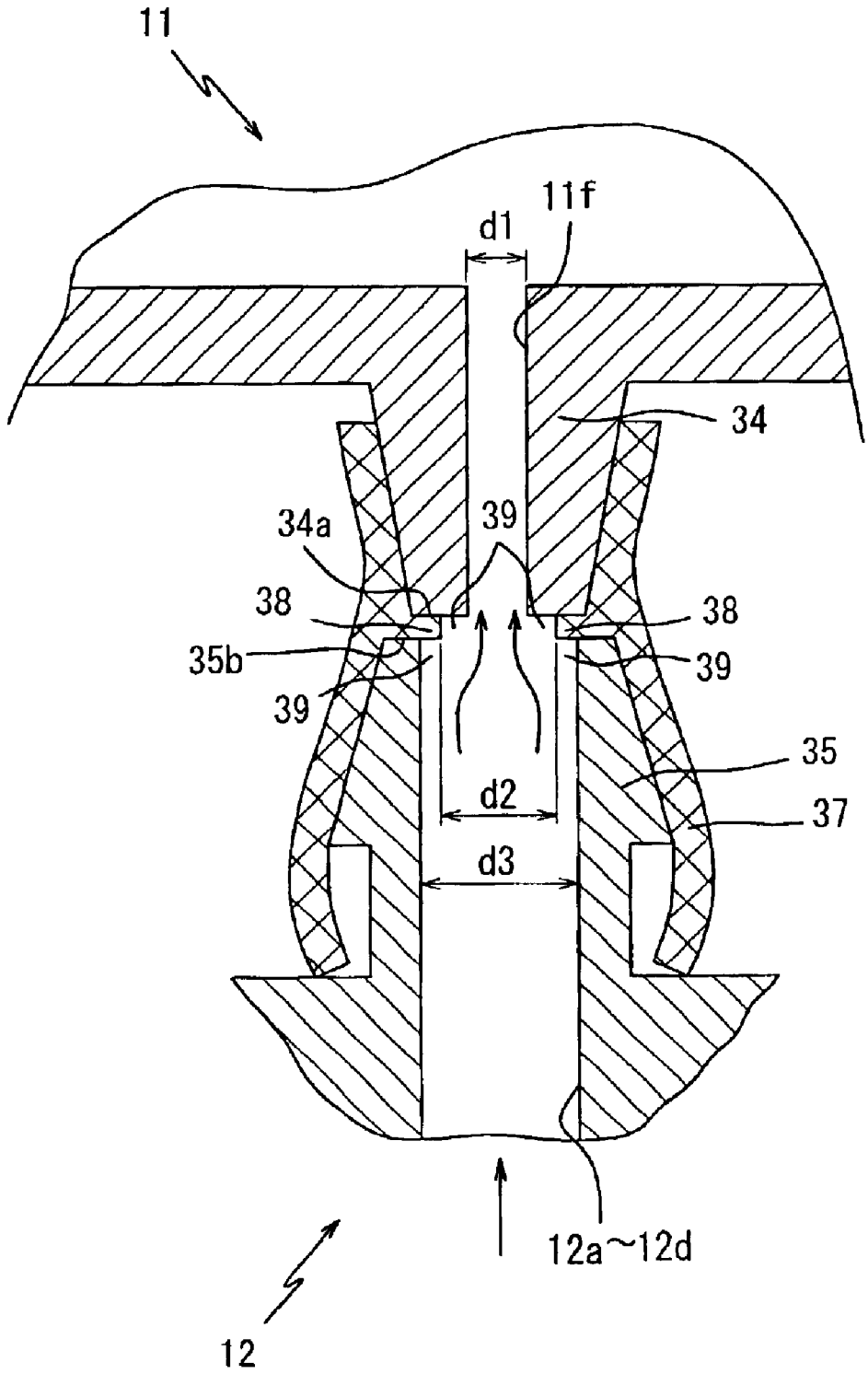
FIG. 3 is an enlarged cross-sectional view showing a connection between a first joint of a joint unit and a joint of an air trap unit.

Referring first to FIG. 3, a connection between the joint 34 of the air trap unit 11 and the first joint 35 of the joint unit 12 will be described. FIG. 3 is an enlarged cross-sectional view showing a connection between the joint 34 and the first joint 35. In FIG. 3, the first joint 35 is shown below the joint 34 and ink flows from the first joint 35 to the joint 34 in the directions of the arrows.

As described above, the joint 34 and the first joint 35 are connected by a connector 37. The connector 37 is an elastic body in the form of a hollow cylinder. A ring-shaped sealing portion 38 projects from a middle part of the inner periphery of the cylinder. An ink path formed inside the joint 34 has an inner diameter d1 of about 1.5 mm, the sealing portion 38 has an inner diameter d2 of about 2.0 mm, and an ink path formed inside the first joint 35 has an inner diameter d3 of about 2.2 mm.

The joint 34 is inserted from one end of the connector 37 to the sealing portion 38, and the first joint 35 is inserted from the other end of the connector 37 to the sealing portion 38. The joint 34 and the first joint 35 are surrounded by the connector 37, and thereby connected to each other. The connector 37 radially expands at the head of the first joint 35 and contracts at the neck of the first joint 35. At this time, the joint 34 and the first joint 35 are opposed to each other at their open ends, and the sealing portion 38 is sandwiched between the end face 34*a* formed around an opening of the joint 34 and the end face 35*b* formed around an opening of the first joint 35.

When the joint 34, the sealing portion 38, and the first joint 35 are connected, their inner peripheries define an ink path. The ink path has no valley-like gaps between the end faces 34*a*, 35*b* and becomes gradually narrower, from the first joint 35 to the joint 34, in the direction of flow of ink. Accordingly, due to the different ink path diameters, steps 39 are formed facing the flow of ink at the connection between the joints 34, 35. Because ink flows toward the steps 39, the velocity of flow of ink is kept fairly high, thus preventing accumulation of air bubbles at the steps 39.

Figure 4:
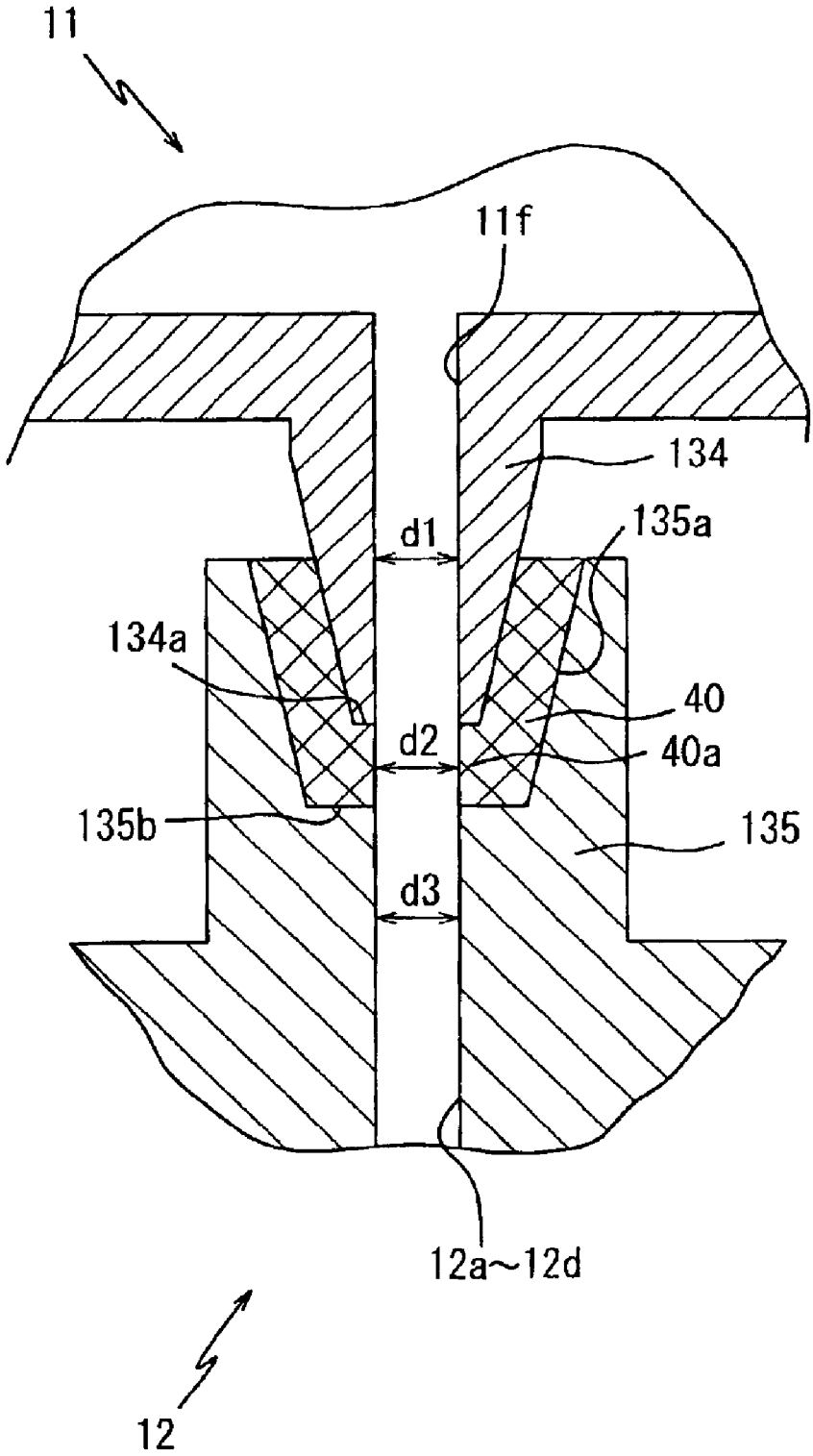
FIG. 4 is an enlarged cross-sectional view showing a connection between an alternate first joint and an alternate joint of the air trap unit.

Referring now to FIG. 4, an alternate form of the joint 34 and the first joint 35 will be described. FIG. 4 is an enlarged cross-sectional view of a joint 134 of the air trap unit 11 and a first joint 135 of the joint unit 12 when they are connected. The same elements designated and described in FIG. 3 will not be described again.

In this alternate form, the joint 134 defines an ink path about 2.2 mm in inner diameter d1. The first joint 135 has a substantially cylindrical outer periphery and has a tapered recess 135*a* facing the joint 134 to receive the joint 134. The first joint 135 defines an ink path about 2.2 mm in inner diameter d3. A connector 40 formed by an elastic body is tapered at its inner and outer peripheries and has a sealing portion 40*a* at its one end, which defines an ink path about 2.2 mm in inner diameter d2.

The connector 40 is brought into intimate contact with the tapered outer periphery of the joint 134 and with the tapered recess 135*a* of the first joint 135. The joint 134 is fitted into the recess 135*a* of the first joint 135 and connected to the first joint 135 via the connector 40. At this time, the sealing portion 40*a* is sandwiched by the end face 134*a* of the joint 134 and the inner end face of the recess 135*b*. When the joint 134, the connector 40, and the first connector 135 are connected, their inner peripheries become flush with each other and define an ink path about 2.2 mm in inner diameter. Accordingly, no step or gap is formed between the end face 134*a* and the inner end face 135*b*, and thus an ink ejection failure due to accumulation of air bubbles is prevented. In addition, the connector 40, formed by a resilient body, closely contacts the outer periphery of the joint 134 and provides a good seal around the joint 134 against the entry of air from the outside.

In FIG. 3, the joint 34, the first joint 35, and the sealing portion 38 may be designed to define an ink path that has a uniform inner diameter as in FIG. 4. In FIG. 4, the joint 134, the first joint 135, and the sealing portion 40*a* may be designed to define an ink path that has different inner diameters and becomes narrower in the direction of flow of ink in FIG. 3. In FIGS. 3 and 4, it is preferable that the sealing portions 38, 40*a* are compressed between the end faces of the associated joints.

Figure 5:
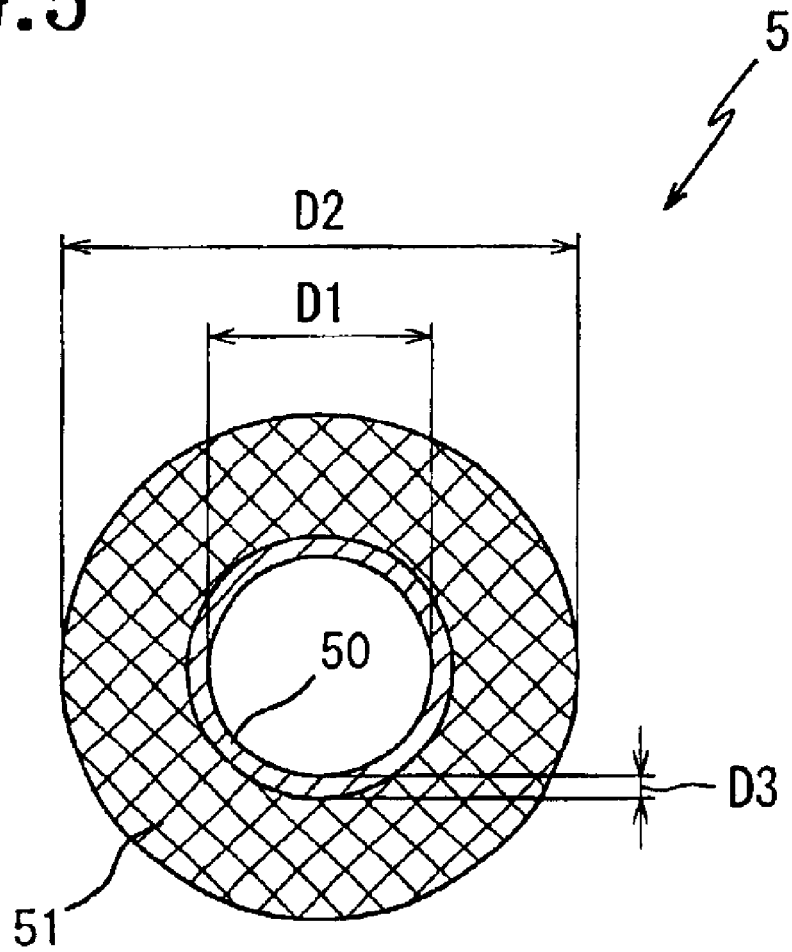
FIG. 5 is an enlarged cross-sectional view of a tube.
Figure 6:
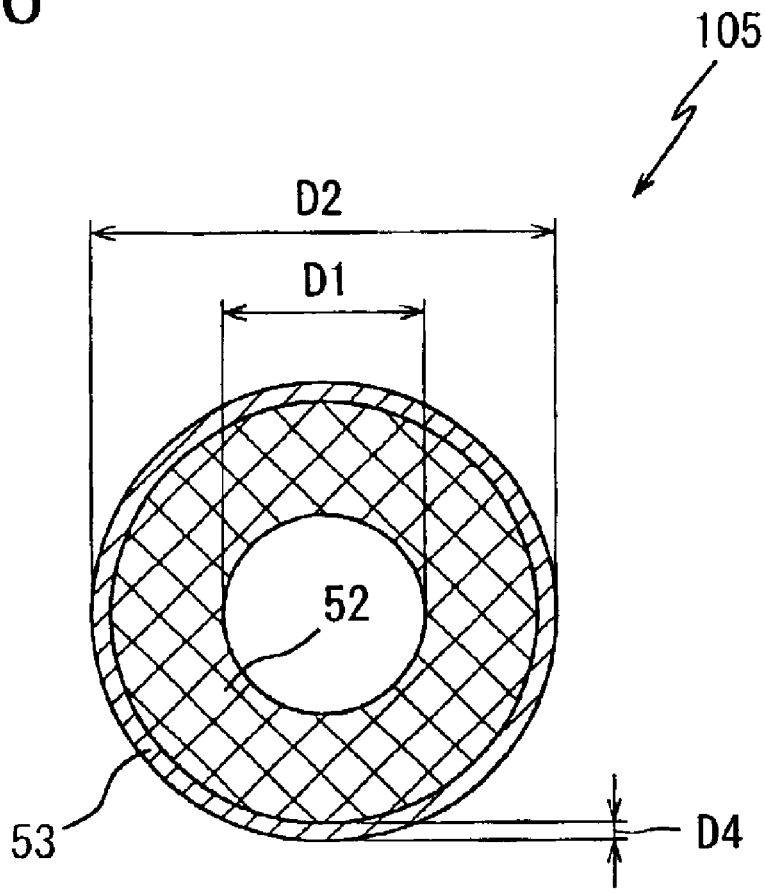
FIG. 6 is an enlarged cross-sectional view of an alternate tube.

Referring now to FIGS. 5 and 6, the structure of the tube 5 used in the ink-jet printer 1 will be described. FIG. 5 is an enlarged cross-sectional view of the tube 5. The ink tube 5 is double-layered and has an inner layer 50 that contacts ink and an outer layer 51 fitted over the outer periphery of the inner layer 50. The tube 5 preferably has an inner diameter D1 of about 1.4 mm and an outer diameter D2 of about 3.0 mm. In the ink-jet printer 1, however, the tube 5 may have an inner diameter D1 of between about 0.8–2.0 mm, and an outer diameter of between about 2.4–4.0 mm. The inner layer 50 may have a thickness D3 of between about 60–80 $\mu$m, and preferably about 75 $\mu$m. The outer layer 51 is preferably more than twice as thick as the inner layer 50 to make the tube 5 kink resistant.

The inner layer may be formed of resins with low vapor and gas permeability, such as olefin base resins or fluorine base resins, namely, fluorinated ethylene propylene (FEP), polytetrafluoroethylene (PTFE), polyethylene (PE), and polypropylene. The inner layer is preferably formed of fluorinated ethylene propylene (FEP).

The outer layer may be formed of highly flexible and elastic olefin base rubber, silicon base rubber, or fluorine base rubber, such as silicon rubber and fluororubber (FKM). The outer layer is preferably formed of silicon rubber. The outer layer may have a Shore A hardness of about 60–80, and preferably about 70.

The following table shows the results of comparative tests conducted on single-layer and double-layer tubes formed of polyethylene (PE) and other materials.

| Material of Tube | Ink Drying Properties | Flexibility | Buckling Resistance |
|---|---|---|---|
| Inner Layer: FEP<br>Outer Layer: Silicon Rubber | o | o | o |
| PTFE | • | x | x |
| PE | o | x | x |
| FKM | Δ | o | o |
| FEP | • | x | x |
| Silicon Rubber | x | o | o |
| Inner Layer: PE<br>Outer Layer: Olefin Rubber | o | o | o |

In the experiments, single-layer tubes and double-layer tubes were set to have the same inner diameter D1 and the same outer diameter D2. To evaluate ink drying properties, that is, vapor and gas permeability, tubes formed of various materials were filled with ink and left alone for about three months, and changes in ink weight were measured. In the table, • indicates the cases where changes in ink weight were very little, o indicates the cases where changes in ink weight were little, and Δ indicates the cases where changes in ink weight were noticeable. Additionally, to evaluate flexibility and buckling resistance, the tubes were bent repeatedly and checked for any tear or breakage. In the table, o indicates the cases where no tear or breakage was produced, and x indicates the cases where a tear or breakage was found.

Single-layer tubes formed of FEP, PTFE, and PE provided excellent results in the ink drying test, but provided poor results in the flexibility and buckling resistance tests. Single-layer tubes formed of FKM and silicon rubber provided poor results in the ink drying test, but provided excellent results in the flexibility and buckling resistance tests. These results suggested that the use of a tube having a layer formed of FEP, PTFE, or PE and another layer formed of FKM or silicon rubber would provide excellent results in each test. For verification, the above-described tests were conducted on a tube having an inner layer formed of PE and an outer layer formed of olefin rubber. In each test, excellent results were obtained. In addition, when the tapered portion of the joint 36 was press-fitted into such a double-layer tube, the tube provided a good seal around the tapered portion without being torn or broken.

In the double-layer tube 5 shown in FIG. 5, the inner layer 50 formed of FEP or other suitable materials prevents evaporation of moisture contained in the ink and air permeation through the tube 5, and the outer layer 51 formed of silicon rubber or other suitable materials is flexible enough to provide flexibility and buckling resistance required by the ink-jet printer 1. Additionally, the inner layer 50 is set to have a thickness D3 of about 75 μm, which is not too thick to reduce flexibility of the tube 5. The outer layer 51 is set to have a Shore A hardness of 70, which is just right for reducing the bending stress exerted on the inner layer 50. In addition, the inner layer 50 formed of FEP and the outer layer 51 formed of silicon rubber can be firmly bonded to each other by treating the FEP surface using etchants, i.e., etching agents, such as TETRA-ETCH®. When the inner layer 50 and the outer layer 51 are respectively formed of olefin base resin and olefin base rubber, which are of the same type of material, the inner and outer layers 50, 51 can be simultaneously formed by extrusion and firmly bonded to each other by melting.

Referring now to FIG. 6, an alternate form of the tube 5 will be described. FIG. 6 is an enlarged cross-sectional view of an alternate tube 105. The tube 105 is double-layered and has an inner layer 52 that contacts ink and an outer layer 53 bonded over the outer periphery of the inner layer 52. The tube 105 has an inner diameter D1 of about 1.4 mm and an outer diameter D2 of about 3.0 mm. The inner layer 52 is formed of silicon rubber and has a Shore A hardness of about 70. The outer layer 53 is formed of FEP and has a thickness D4 of about 75 μm. In short, the alternate tube 105 is formed by reversing the inner layer 50 and the outer layer 51 of the tube 50 shown in FIG. 5. The tube 105 is as effective as the tube 5 in preventing vapor and air transmission through the tube 105 and reducing the bending stress exerted on the tube 105. The above-described materials suitable for the inner and outer layers 50, 51 can be used for the outer and inner layers 53, 52, respectively.

Referring now to FIGS. 7–10, a connection between the second joint 36 of the joint unit 12 and the tube 5, shown in FIG. 2, will be described. FIGS. 7A and 7B show a first method of connecting the second joint 36 to the tube 5. As described referring to FIG. 2, the second joint 36 has a neck 36*b* projecting from the body of the joint unit 12 and a bead 36*a* extending from the neck 36*b* and tapered down toward the corresponding tube 5*a*–5*d*. The head 36*a* has a maximum diameter larger than the inner diameter D1 of the tube 5, and the neck 36*b* has an smaller diameter than the maximum diameter of the head 36*a*. The second joint 36 has a corresponding one of the ink paths 12*a*–12*d* formed therein. The outer diameter d1 of the tapered end of the head 34*a* is about 1.3 mm, while the inner diameter D1 of the tube 5 is about 1.4 mm. Thus, the outer diameter d1 of the tapered end of the head 36*a* is smaller than the inner diameter D1 of the tube 5 by about 0.1 mm. When the second joint 36 is inserted into the tube 5, a gap is created between the outer periphery of the tapered head 36*a* and the inner periphery of the tube 5.

Figure 7A:
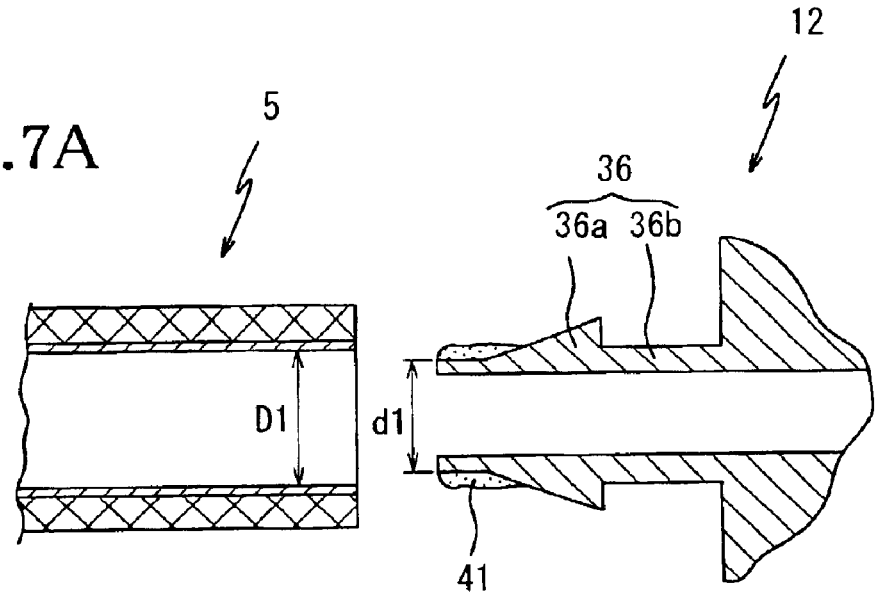
FIGS. 7A and 7B show a first method of connecting a second joint of a joint unit and a tube.
Figure 7B:
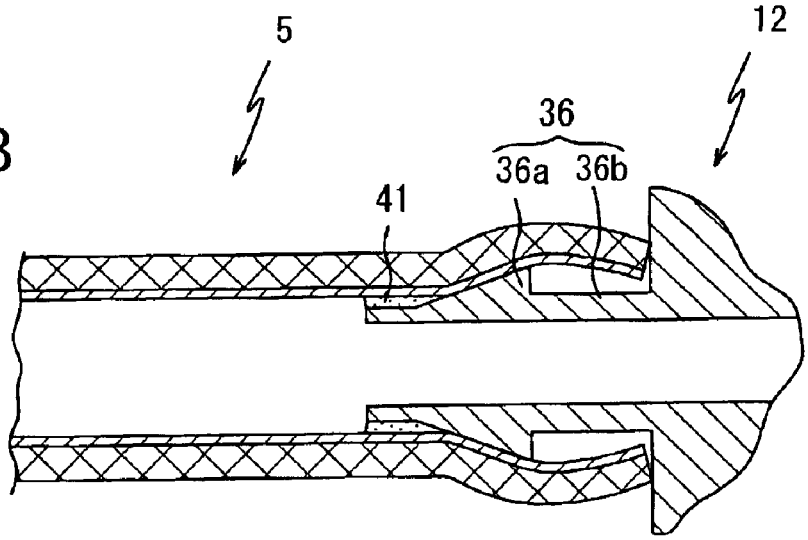

FIG. 7A shows a first method of connecting the second joint 36 to the tube 5. Glycerin 41 is first applied to the tapered end of the head 36*a*, at least to a portion having a smaller diameter than the inner diameter D1 of the tube 5. Then, as shown in FIG. 7B, the second joint 36 applied with glycerin is inserted into the tube 5. Thereby, the second joint 36 is connected to the tube 5 while a gap created between the outer periphery of the tapered head 36*a* and the inner periphery of the tube 5 is filled with glycerin. Accordingly, an ink ejection failure due to accumulation of air bubbles is prevented. Further, although a step is formed, because the velocity of the flow of ink past the step is fairly high, the accumulation of air bubbles is prevented. Alternatively, glycerin 41 may be applied to the inner periphery of the tube 5.

Figure 8A:
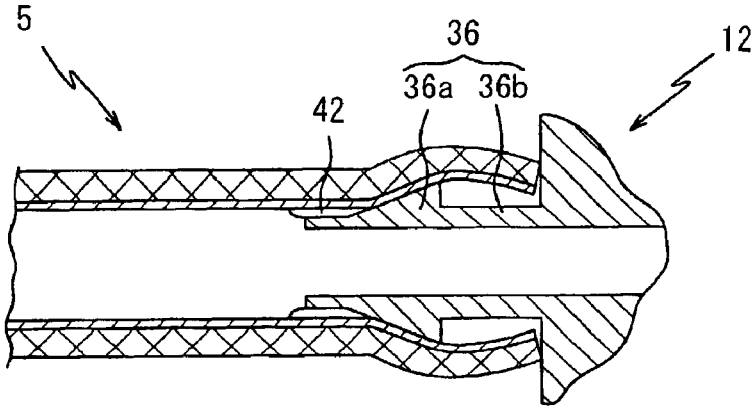
FIGS. 8A, 8B, and 8C show a second method of connecting the second joint and the tube.
Figure 8B:
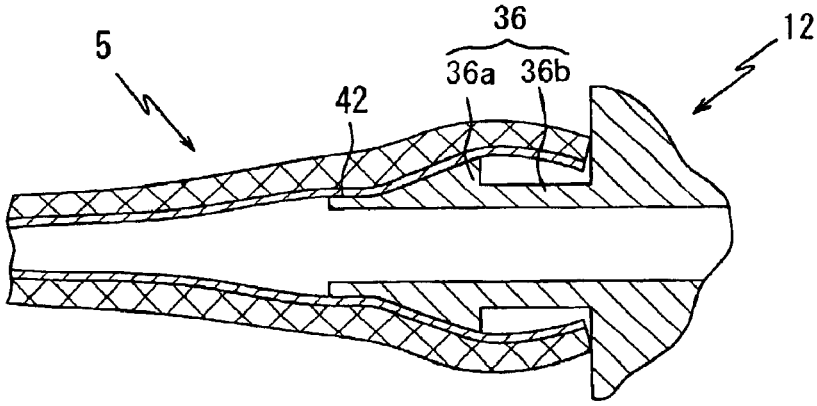
Figure 8C:
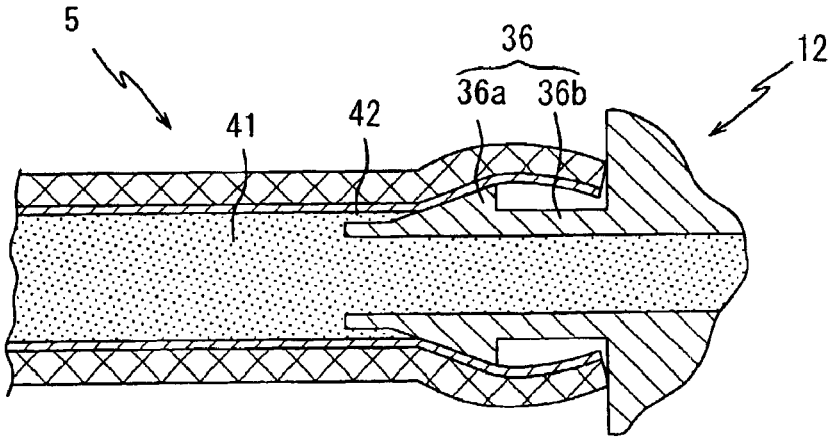

FIGS. 8A–8C show a second method of connecting the second joint 36 to the tube 5 while eliminating air bubbles from their connection. The same elements as designated and described in FIGS. 7A and 7B will not be redundantly described.

As shown in FIG. 8A, the second joint 36 is first inserted into the tube 5 to establish a connection therebetween. In this case, because the outer diameter d1 of the tapered end of the head 36*a* is smaller than the inner diameter D1 of the tube 5, a gap 42 is created between the second joint 36 and the tube 5. Then, as shown in FIG. 8B, the pressure inside the connected second joint 36 and tube 5 is reduced using a vacuum pump or the like to discharge air from the gap 42. Then, as shown in FIG. 8C, glycerin 41 is supplied into the connected second joint 36 and tube 5 under the reduced pressure. Thereafter, the pressure is returned to an atmospheric pressure. Even after glycerin 41 is discharged from the ink path 12*a*–12*d*, the gap 42 remains filled with glycerin 41, as in FIG. 7B. Accordingly, no air is trapped in the gap 42, and an ink ejection failure due to accumulation of air bubbles is prevented.

FIGS. 9A–9D show a third method of connecting the second joint 36 to the tube 5 while eliminating air bubbles from their connection. The same elements as designated and described in FIGS. 7A and 7B will not be redundantly described.

Figure 9A:
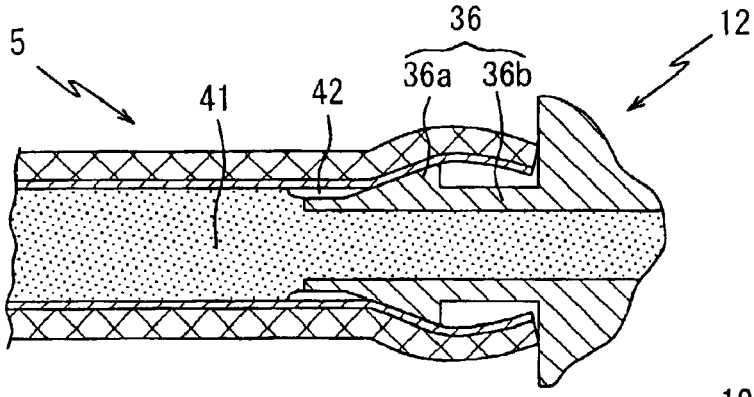
FIGS. 9A, 9B, 9C, and 9D show a third method of connecting the second joint and the tube.
Figure 9B:
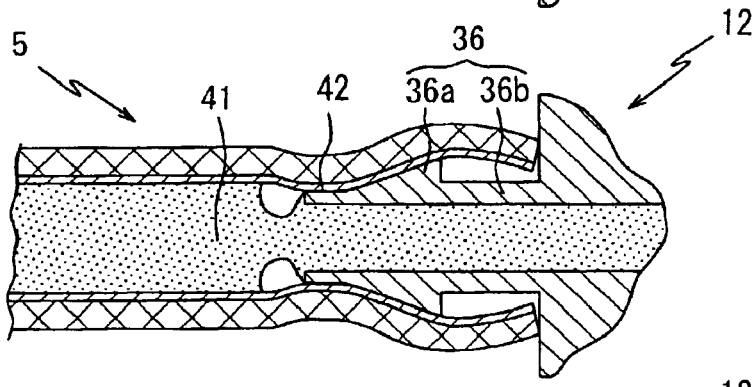
Figure 9C:
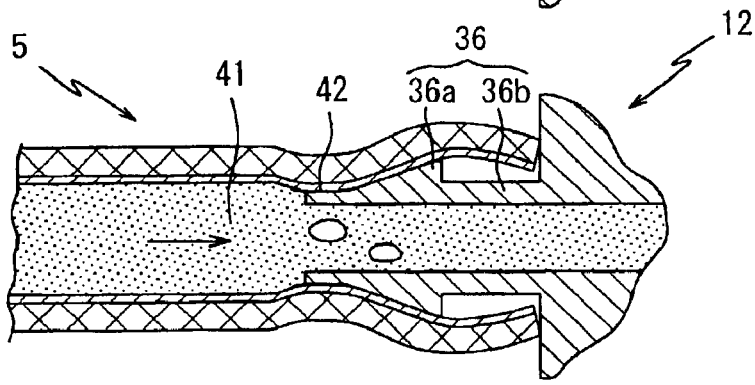
Figure 9D:
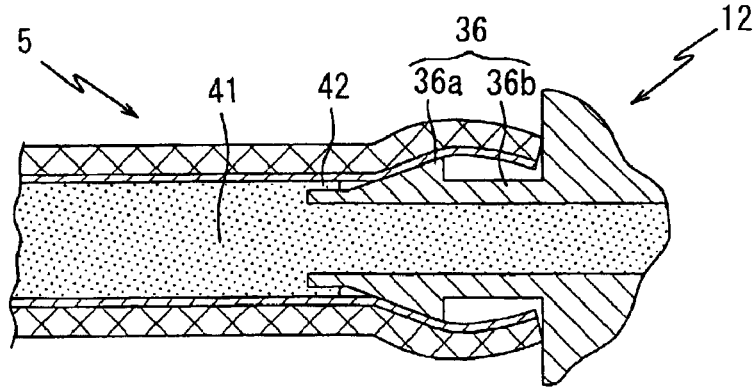

As shown in FIG. 9A, the second joint 36 is first inserted into the tube 5, and glycerin 41 is supplied into the connected second joint 36 and tube 5. In this case, because the outer diameter d1 of the tapered end of the head 36*a* is smaller than the inner diameter D1 of the tube 5, a gap 42 is created between the second joint 36 and the tube 5, and the gap is filled with air. Then, as shown in FIG. 9B, the pressure inside the connected second joint 36 and tube 5 is reduced to expand the air trapped in the gap 42. Glycerin 41 remains unchanged because a liquid is uncompressive. Then, as shown in FIG. 9C, glycerin 41 is again supplied into the connected second joint 36 and tube 5 to discharge the expanded air with the velocity of flow of glycerin. When the pressure is returned to an atmospheric pressure, the gap 42 is filled with a small amount of compressed air and glycerin 41. Even after glycerin 41 is discharged from the ink path 12*a*–12*d*, glycerin 41 remains in the gap 42, as in FIG. 7B. Accordingly, an ink ejection failure due to accumulation of air bubbles is prevented.

In FIGS. 7–9, various filling liquids, including glycerin, which are used to fill printheads when shipped are commonly used as liquids to fill the gap. Specifically, a liquid obtained by removing a colorant and a volatile component from ink used for printheads is preferable as a filling liquid. Alternatively, ink actually used for printheads may be used.

Figure 10A:
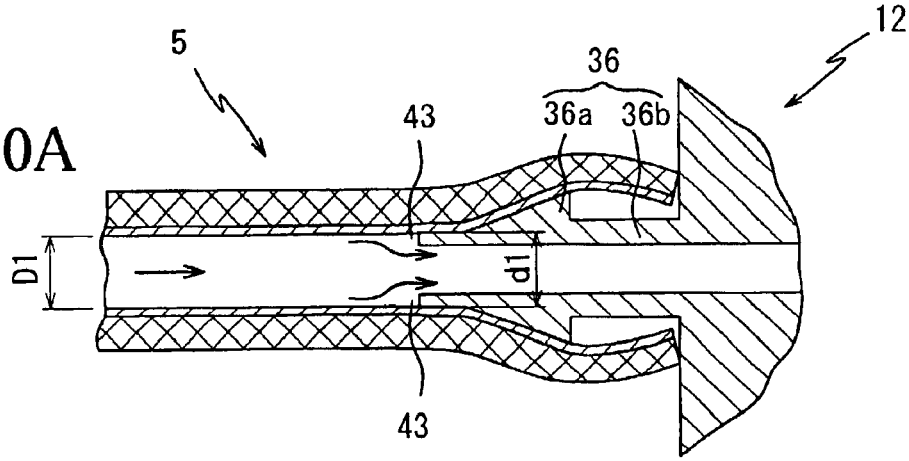
FIGS. 10A and 10B are connections between differently sized second joints and the tubes.
Figure 10B:
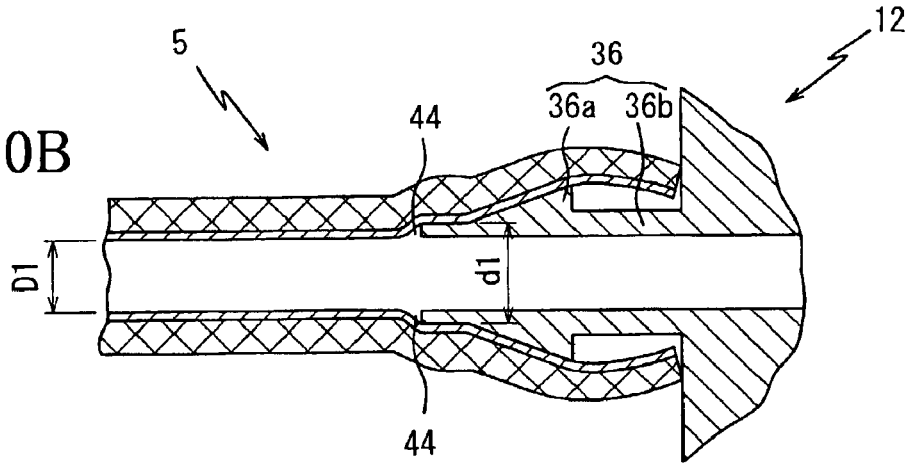

FIGS. 10A and 10B show connections between the second joint 36 and the tube 5, when the outer diameter d1 of the tapered end of the head 36*a* is set differently. The same elements as designated and described in FIGS. 7A and 7B will not be redundantly described.

In FIG. 10A, the outer diameter d1 of the tapered end of the head 36*a* is set to be about 1.4 mm, while the inner diameter D1 of the tube 5 is set to be about 1.4 mm. In other words, the outer diameter d1 of the tapered end of the head 36*a* is equal to or slightly larger than the inner diameter D1 of the tube 5. Thus, when the second joint 36 is inserted into the tube 5 to establish a connection therebetween, no gap is created between the outer periphery of the tapered head 36*a* and the inner periphery of the tube 5. However, a step 43 is created at the tapered end of the head 36*a* so as to face the flow of ink, due to the different inner diameters of the second joint 36 and the tube 5. Because ink flows toward the step 43, the velocity of flow of ink is fairly high, thus preventing accumulation of air bubbles at the step 43 and an ink ejection failure caused by accumulated air bubbles.

Alternatively, in FIG. 10B, the outer diameter d1 of the tapered end of the head 36*a* is set to be about 1.5 m, while the inner diameter D1 of the tube 5 is set to be about 1.4 mm. In other words, the outer diameter d1 of the tapered end of the head 36*a* is larger than the inner diameter D1 of the tube 5 by about 0.1 mm. Thus, when the second joint 36 is inserted into the tube 5 to establish a connection therebetween, a recess 44 is created in the ink path. Air bubbles are less likely to be trapped in such a recess 44 than in the gap 42 (FIG. 8A) created between the outer periphery of the tapered head 36*a* and the inner periphery of the tube 5. Accordingly, an ink ejection failure caused by air bubbles is prevented. As described referring to FIG. 5, because the tube 5 may be formed to have an inner diameter of between about 0.8–2.0 mm and an outer diameter of between about 2.4–4.0 mm, the head 36*a* in the above-described exemplary methods may be dimensioned in proportion to the inner and outer diameters of the tube 5.

Figure 11:
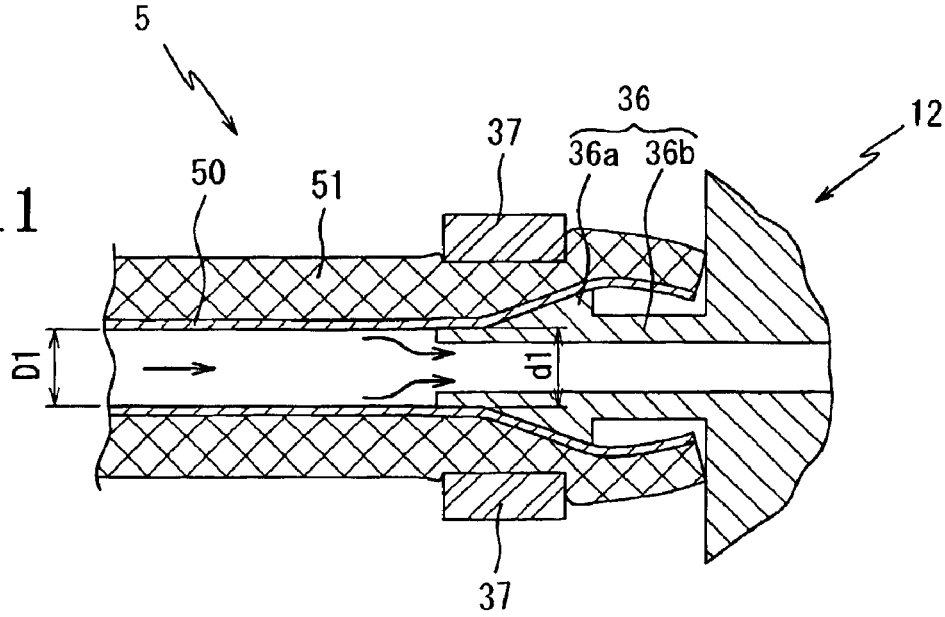
FIG. 11 is an enlarged cross-sectional view showing a connection between a second joint and a tube using a locking member.

FIG. 11 shows a connection between the second joint 36 and the tube 5 additionally using a locking member 37. The second joint 36 and the tube 5 are dimensioned similarly to those in FIG. 10A, and the head 36*a* of the second joint 36 has, at its tapered end, an outer diameter d1 of about 1.4 mm, which is substantially equal to or slightly larger than the inner diameter D1 of the tube 5. The locking member 37 is provided to lock the outer periphery of the tube 5 covering the second joint 36.

The locking member 37 is formed as a substantially hollow cylinder, and has an inner diameter smaller than the outer diameter of a connection between the tube 5 and a maximum-diameter portion of the head 36*a*. Thus, when the locking member 37 is fitted around the outer layer 51 of the tube 5 covering the second joint 36, the locking member 37 presses the flexible outer layer 51 formed of silicon rubber to bring the tube 5 into more intimate contact with the second joint 36. At this time, the locking member 37 extends over the outer layer 51 of the tube 5 generally from the tapered end of the head 36*a* to the maximum-diameter portion of the head 36*a*. Accordingly, even when the tube 5 moves randomly as the printhead unit 3 (carriage 3*a*) reciprocates, the tube 5 and the second joint 36, connected to each other, are unlikely to be loosened to permit the entry of air therebetween and unlikely to be detached from each other. Especially, silicon rubber is highly restorable and unlikely to be plastically deformed by the pressure from the locking member 37, and thus intimate contact between the second joint 36 and the inner layer 50 of the tube 5 can be maintained for a long time.

Figure 12:
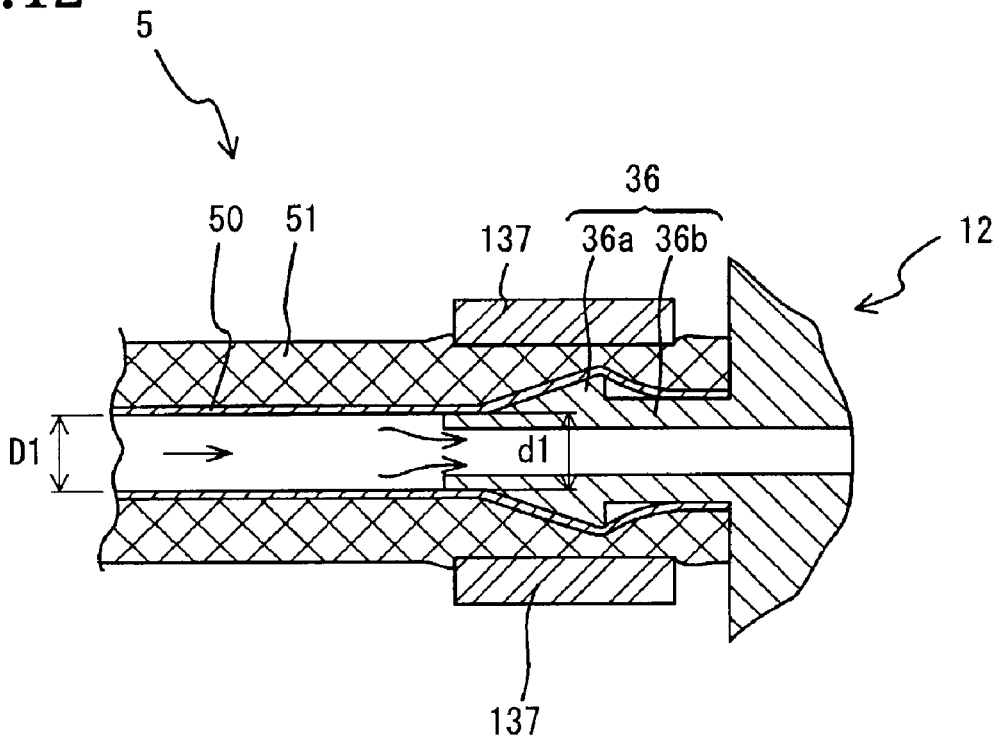
FIG. 12 is an enlarged cross-sectional view showing a connection between the second joint and the tube using an alternate locking member.

Referring now to FIG. 12, a locking member 137, as an alternate form of the locking member 37 in FIG. 11, will be described. The locking member 137 is longer than the locking member 37 in the axial direction. When the locking member 37 is fitted around the outer layer 51 of the tube 5 covering the second joint 36, the locking member 137 presses the outer layer 51 over a longer length to fit the inner layer 50 tightly to the second joint 36. At this time, the locking member 137 extends over the outer layer 51 of the tube 5 generally from the tapered end of the head 36*a* to the middle of the neck 36*b*. Accordingly, the long locking member 137 locks the interconnected tube 5 and second joint 36 more securely and prevents them from being loosened or detached from each other, even when the tube 5 and the second joint 36 expand or contract with changes in temperature.

Figure 13A:
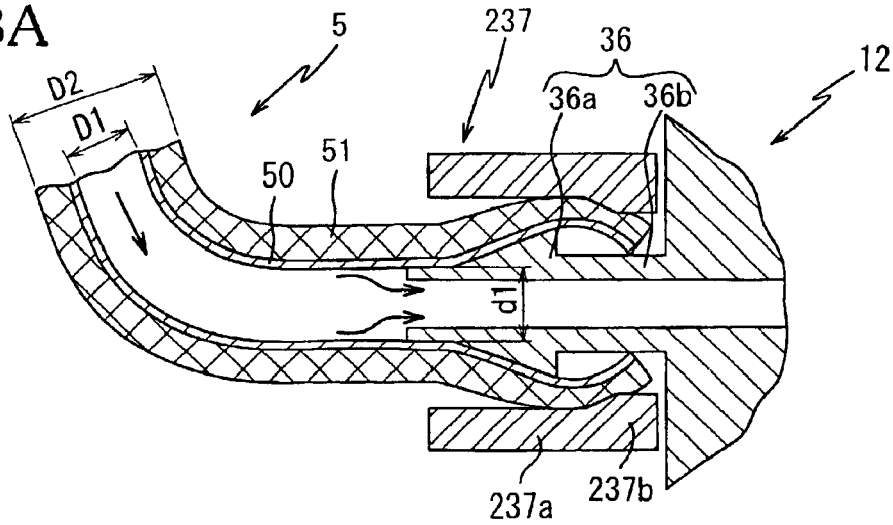
FIG. 13A is an enlarged cross-sectional view showing a connection between the second joint and the tube using an alternate locking member.
Figure 13B:
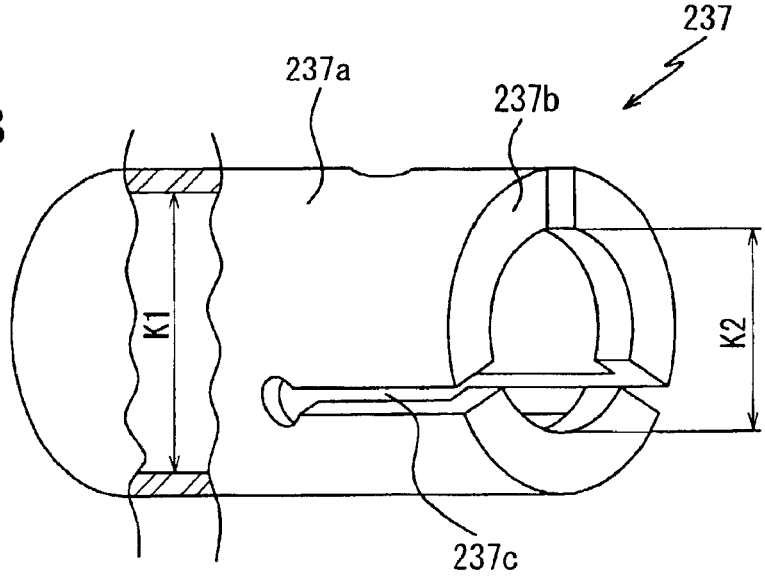
FIG. 13B is an enlarged perspective view of the alternate locking member of FIG. 13A.

Referring now to FIGS. 13A and 13B, a locking member 237, as an alternate form of the locking member 37 in FIG. 11, will be described. As shown in FIG. 13B, the locking member 237 is substantially cylindrical and has higher rigidity than the tube 5. The locking member 237 has a first inner-diameter portion 237*a* and a second inner-diameter portion 237*b*. The first inner-diameter portion 237*a* has a first inner diameter K1 smaller than the outer diameter of the connection between the tube 5 and the maximum-diameter portion of the head 36*a* of the second joint 36. The second inner-diameter portion 237*b* projects radially inwardly and has a second inner diameter K2 smaller than the first inner diameter K1. Further, slits 237*c* are formed from an end of the second inner-diameter portion 237*b* to the first inner-diameter portion 237*a* to divide the second inner-diameter portion 237*b* into several segments, each having radial resilience. The tube 5 covering the second joint 36 is inserted into the locking member 237, which in turn locks the interconnected tube 5 and second joint 36.

Because the first inner diameter K1 is smaller than the outer diameter of the connection between the tube 5 and the maximum-diameter portion of the second joint 36, the first inner-diameter portion 237*a* of the locking member 237 compresses the flexible outer layer 51 of the tube 5, and the compressed tube 5 presses the second joint 36. Thereby, the locking member 237 locks the connection between the tube 5 and the second joint 36. In addition, the second inner-diameter portion 237*b* with slits 237*c* is enlarged in inner diameter K2 to allow the connection between the tube 5 and the maximum-diameter portion of the second joint 36 to be inserted into the second inner-diameter portion 237*b*. The second inner-diameter portion 237*b* presses the tube 5 against the neck 36*b* of the second joint 36. Thus, the tube 5 radially expanded by the maximum-diameter portion is radially compressed toward the neck 36*b*. This structure effectively prevents the tube 5 from being detached from the second joint 36. In addition, because silicon rubber used for the outer layer 51 of the tube 5 is highly restorable and unlikely to be plastically deformed by the pressure from the locking member 237, intimate contact between the second joint 36 and the inner layer 50 of the tube 5 can be maintained for a long time.

Figure 14:
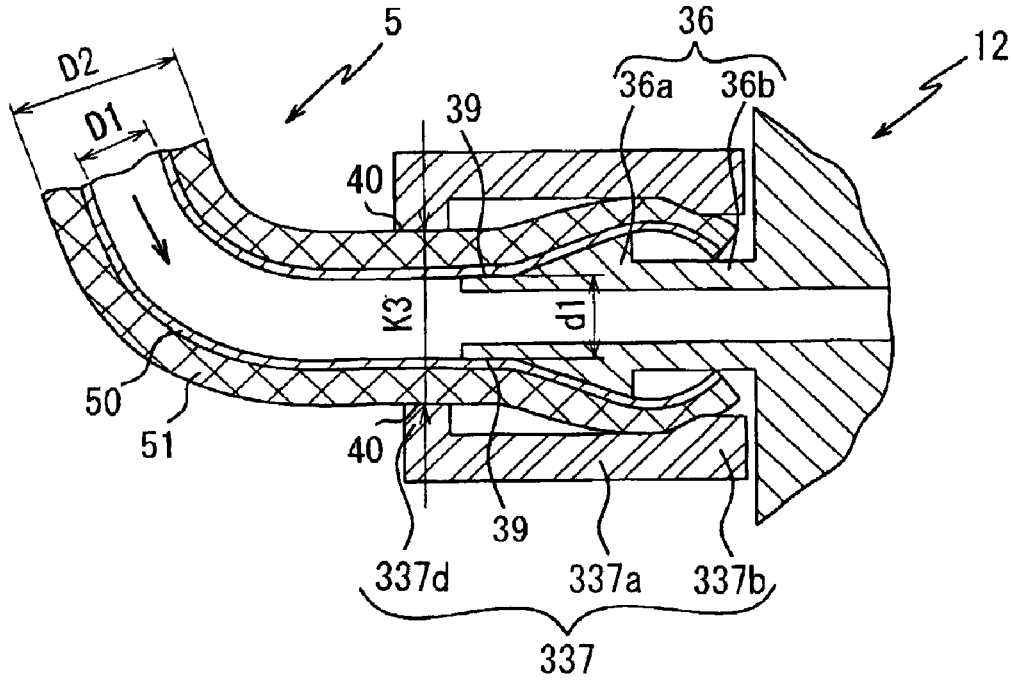
FIG. 14 is an enlarged cross-sectional view showing a connection between the second joint and the tube using a second alternate locking member.

Referring now to FIG. 14, a locking member 337 as an alternate form of the locking member 237 will be described. FIG. 14 shows the tube 5, the second joint 36, and the locking member 337 when they are connected. The same elements as designated and described in FIGS. 13A and 13B will not be redundantly described. The locking member 337 has a first inner-diameter portion 337*a* and a second inner-diameter portion 337*b* extending from one end of the first inner-diameter portion 337*a*. The first and second inner-diameter portions 337*a*, 337*b* of the locking member 337 are similar to the first and second inner-diameter portions 237*a*, 237*b* of the locking member 237. Additionally, the locking member 337 has a third inner-diameter portion 337*d* that projects radially inwardly from the other end of the first inner-diameter portion 337*a* and has a third inner diameter K3 substantially equal to the outer diameter D2 of the tube 5. When the tube 5 and the second joint 36 are locked by the locking member 337 in the same manner as in FIGS. 13A, the third inner-diameter portion 337*d* is brought into contact with the outer periphery of the tube 5, in a close vicinity to a contact portion 39 between the outer periphery of the tapered end of the second joint 36 and the inner layer 50 of the tube 5.

The second joint 36 and the tube 5 are dimensioned similarly to those in FIG. 10A. The inner diameter D1 of the tube 5 is substantially equal to or slightly smaller than the outer diameter d1 of the tapered end of the second joint 36 to prevent accumulation of air. Thus, when the second joint 36 is connected to the tube 5, the outer periphery of the tapered end of the second joint 36 contacts the inner layer 50 of the tube 5. Without the third inner-diameter portion 337*d*, random movements of the tube 5 caused by the reciprocating printhead unit 3 (carriage 3*a*) would exert stresses in the vicinity of the contact portion 39 between the second joint 36 and the tube 5, and such stresses would cause a crack in the inner layer 50 formed of a hard material, such as fluorinated ethylene propylene (FEP).

However, because the third inner-diameter portion 237*d* is provided on the outer layer 51 of the tube 5, on the opposite side of the contact portion 39 from the second joint 36, random movements of the tube 5 will exert stresses at a contact portion 40 between the third inner-diameter portion 337*d* and the outer layer 51 of the tube 5. The outer layer 51 of the tube 5 formed of silicon rubber absorbs such stresses with the resiliency of the silicon rubber.

As described above, by the use of the locking member 37, 137, 237, 337 the interconnected tube 5 and second joint 36 are firmly locked. Accordingly, even when the tube 5 moves randomly as the printhead unit 3 (carriage 3*a*) reciprocates, the locking member 37, 137, 237, 337 prevents the tube 5 from being detached from the second joint 36.

Although the above-described locking member 37, 137, 237, 337 is formed into a substantially hollow cylinder, the locking member 37, 137, 237, 337 may take various forms. For example, the inner periphery of the locking member 37, 137, 237, 337 may be tapered so as to follow the contour of the outer periphery of the head 36*a*. In this case, the tube 5 is locked more firmly by the locking member 37, 137, 237, 337 and the head 36*a*. Alternatively, the locking member 37, 137, 237, 337 may be formed into a belt to be wrapped around the connection between the tube 5 and the second joint 36.

Figure 15:
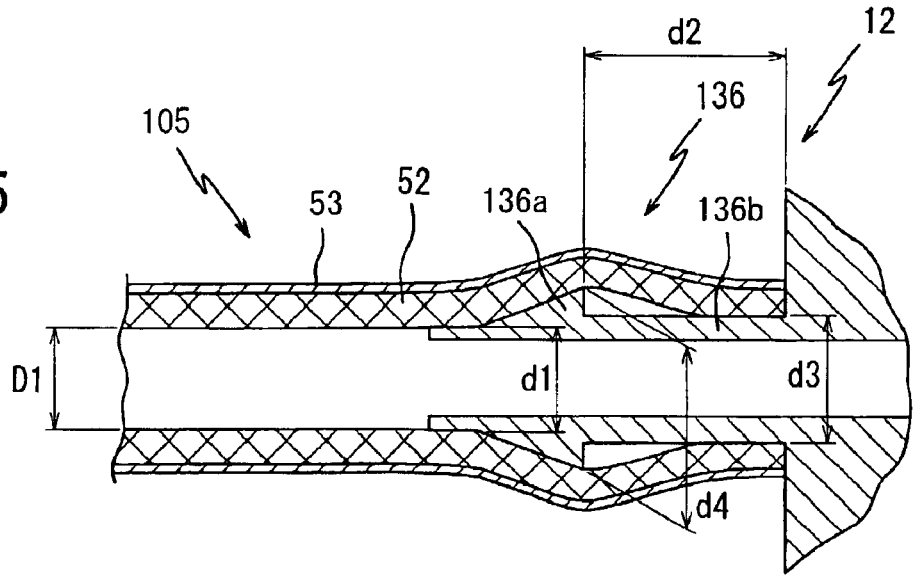
FIG. 15 is an enlarged cross-sectional view showing a connection between a second joint with a longer neck and the tube of FIG. 6.

Referring now to FIG. 15, a connection between the tube 105 shown in FIG. 6 and a second joint 136 that has a longer neck 136*b* than the second joint 36 will be described. As shown in FIG. 15, the second joint 136 has a maximum diameter d4 larger than the inner diameter D1 of the tube 105. The second joint 136 has a head 136*a* tapered down toward its open end and a neck 136*b* that extends from the maximum-diameter portion and has a smaller diameter than the maximum-diameter portion. The outer diameter d1 of the tapered end of the head 136*a* is about 1.4 mm, which is substantially equal to or slightly larger than the inner diameter D1 (about 1.4 mm) of the tube 105. The maximum diameter d4 is about 2.5 mm. The neck 136*b* has a length d2 of about 2.5 mm and an outer diameter d3 of about 1.6 mm. However, the tube 105 may variably sized to have an inner diameter of between about 0.8–2.0 mm and an outer diameter of between about 2.4–4.0 mm, and the second joint 136 may be dimensioned in proportion to the inner and outer diameters of the tube 105. The tube 105 and the second joint 136 are interconnected by inserting the head 136*a* and the neck 136*b* of the second joint 136 into the tube 5.

The outer diameter d1 of the tapered end of the head 136*a* is substantially equal to or slightly larger than the inner diameter D1 of the tube 105. This allows the second joint 136 to be inserted fairly easily into the tube 105 and to be connected to the tube 105 without a gap created between the outer periphery of the tapered head 136*a* and the inner periphery of the inner layer of the tube 105. The absence of a gap prevents air accumulation and clogging of the ink path with accumulated air bubbles.

The head 136*a* of the second joint 136 has the maximum diameter d4 larger than the inner diameter D1 of the tube 105 and is tapered down toward its open end. Because the inner layer 52 of the tube 105 is formed of flexible silicon rubber, the tube 105 is gradually radially expanded by the tapered head 136*a* and expanded most at its maximum-diameter portion. Thus, the inner periphery of the tube 105 closely contacts the outer periphery of the head 136*b*, thereby preventing the entry of air between the tube 105 and the second joint 136.

In addition, the length d2 of the neck 136*b* is about 2.5 mm, and the difference between the outer diameter d3 of the neck 136*b* and the maximum diameter d4 of the head 36*a* is about 0.9 mm. If a force pulling the tube 105 out of the second joint 136 is applied to the tube 105, the second joint 136 thus dimensioned provides a sufficient resistance against expansion of the end of the tube 105 toward the head 136*a*. Accordingly, the tube is hardly loosened or detached from the second joint 136 when the printhead unit 3 (carriage 3*a*) reciprocates.

According to experiments carried out by the inventor, the length d2 of the neck 136*b* is preferably about 0.7 or more times, and more preferably about 1.5–2.0 times, the inner diameter D1 of the tube 105, considering the ease of insertion of the second joint 136 into the tube 105 and the strength of the second joint 136. Half the difference between the outer diameter d3 of the neck 136*b* and the maximum diameter d4 of the head 136*a*, which corresponds to the radial length of a step formed by the outer periphery of the neck 36*b* and the maximum-diameter portion of the head 136*a*, is preferably substantially equal to or greater than about 0.3 times the inner diameter D1 of the tube 105.

According to the above-described ink-jet printer 1, the ink path, formed by connecting the first joint 35, 135 and the joint 34 of the air trap unit 11 and by connecting the second joint 36, 136 and the tube 5, 105, is substantially free of air-trapping gaps. Accordingly, clogging of the ink path with accumulated air is unlikely to occur, and, thus, good ink ejection and high print quality are ensured. In addition, the tube 5, 105 is double-layered and has a layer formed of a flexible material and another layer formed of a material with low vapor and gas permeability. Accordingly, the tube 5, 105 is resistant to buckling, flexible enough to provide an air-tight seal around the mating joint, and able to prevent evaporation of moisture contained in the ink and air permeation therethrough.

In the above-described connections between the second joint 36 (FIGS. 7–14) and the tube 5 (FIG. 5) and between the second joint 136 (FIG. 15) and the tube 105 (FIG. 6), the tubes 5, 105 may be interchangeably used. In other words, either of the tubes 5, 105 that have a layer formed of a flexible material and another layer formed of a material with low vapor and air permeability may be used, regardless of which layer is the inner or outer layer.

Further, the connecting structure between the joint 34 and the first joint 35, 135, and the connecting structure between the tube 5, 105 and the second joint 36, 136 may be interchangeably used to connect the joint unit 12 and the air trap unit 11 and to connect the joint unit 12 and the ink source.

Although the invention has been described with reference to a specific embodiment, the description of the embodiment is illustrative only and is not to be construed as limiting the scope of the invention. Various other modifications and changes may occur to those skilled in the art without departing from the spirit and scope of the invention.

What is claimed is:

1. An ink-jet printer, comprising:

a printhead unit that ejects ink onto a printing medium;

an ink source external to the printhead unit; and an ink path through which ink is delivered from the ink source to the printhead unit, the ink path including:

a first ink path forming member that has a head with a maximum-diameter portion and an open end tapered down from the maximum-diameter portion, and a neck extending from the head and having a smaller diameter than the maximum-diameter portion; and a second ink path forming member that is formed of at least a flexible elastic material and has an inner diameter smaller than the maximum diameter of the first ink path forming member, wherein the head and the neck of the first ink path forming member are inserted into the second ink path forming member, the second ink path forming member radially expanding at the maximum-diameter portion and radially contracting at the neck of the first ink path forming member, thereby establishing a connection between the first and second ink path forming members, wherein the second ink path forming member is a double-layer ink tube having one of a first layer and a second layer formed of a resin with low vapor and gas permeability and the other of the first layer and the second layer radially thicker than the one layer and formed of a rubber providing the flexible elastic material.

2. The ink-jet printer according to claim 1, wherein a gap is created between an outer periphery of the open end of the first ink path forming member and an inner periphery of the second ink path forming member, and the gap is filled with a filling liquid.

3. The ink-jet printer according to claim 1, wherein the open end of the first ink path forming member has an outer diameter equal to or larger than the inner diameter of the second ink path forming member.

4. The ink-jet printer according to claim 3, wherein the outer diameter of the open end of the first ink path forming member is between about 1.4 and 1.5 mm, and the inner diameter of the second ink path forming member is between about 1.3 and 1.4 mm.

5. The ink-jet printer according to claim 4, wherein the outer diameter of the open end of the first ink path forming member and the inner diameter of the second ink path forming member are both about 1.4 mm.

6. The ink-jet printer according to claim 1, wherein the neck of the first ink path forming member has a predetermined length, and the second ink path forming member radially contracts over the predetermined length in its axial direction.

7. The ink-jet printer according to claim 6, the neck of the first ink path forming member has the predetermined length that is about 0.7 times or more the inner diameter of the second ink path forming member.

8. The ink-jet printer according to claim 1, wherein the one of the first and second layers is formed of one of an olefin base resin and a fluorine base resin and the other layer is formed of one of an olefin base elastomer, an olefin base rubber, a silicon base rubber, and a fluorine base rubber.

9. The ink-jet printer according to claim 8, wherein the one of the first and the second layer is formed of one of polyethelene and fluorinate ethylene propylene.

10. The ink-jet printer according to claim 8, wherein the one of the first and second layers of the ink tube is formed of silicon rubber while the other layer is formed of fluorinated ethylene propylene.

11. An ink-jet printer, comprising:

a printhead unit that ejects ink onto a printing medium;

an ink source external to the printhead unit; and an ink path through which ink is delivered from the ink source to the printhead unit, the ink path including:

a first ink path forming member that has a head with a maximum-diameter portion and an open end tapered down from the maximum-diameter portion, and a neck extending from the head and having a smaller diameter than the maximum-diameter portion; and a second ink path forming member that is formed of at least a flexible elastic material and has an inner diameter smaller than the maximum diameter of the first ink path forming member, wherein the head and the neck of the first ink path forming member are inserted into the second ink path forming member, the second ink path forming member radially expanding at the maximum-diameter portion and radially contracting at the neck of the first ink path forming member, thereby establishing a connection between the first and second ink path forming members, wherein the ink path further includes a locking member fitted over the second ink path forming member and having a first inner-diameter portion whose inner diameter is smaller than an outer diameter of a connection between the maximum-diameter portion of the first ink path forming member and the second ink path forming member, the first inner-diameter portion pressing an outer periphery of the second ink path forming member and locking the connection.

12. The ink-jet printer according to claim 11, wherein the second ink path forming member is a double-layer ink tube having an inner layer formed of a material with low vapor and gas permeability and an outer layer radially thicker than the inner layer and formed of the flexible elastic material, the outer layer being compressed by the locking member.

13. The ink-jet printer according to claim 12, wherein the inner layer of the ink tube is formed of fluorinated ethylene propylene while the outer layer is formed of silicon rubber.

14. The ink-jet printer according to claim 11, wherein the locking member has a second inner-diameter portion smaller in inner diameter than the first inner-diameter portion, and the second inner-diameter portion radially inwardly projects and compresses the second ink path forming member radially toward the neck of the first ink path forming member.

15. The ink-jet printer according to claim 14, wherein the second inner-diameter portion of the locking member is radially enlargeable to allow the connection between the maximum-diameter portion of the first ink path forming member and the second ink path forming member to be inserted into the locking member.

16. The ink-jet printer according to claim 15, wherein the locking member has slits formed from an end of the second inner-diameter portion to the first inner-diameter portion to allow the connection between the maximum-diameter portion of the first ink path forming member and the second ink path forming member to be inserted into the locking member.

17. The ink-jet printer according to claim 14, wherein the locking member has a third inner-diameter portion that radially inwardly projects and contacts, near the open end of the first ink path forming member, the outer periphery of the second ink path forming member.

18. The ink-jet printer according to claim 17, wherein the third inner-diameter portion has an inner diameter substantially equal to the outer diameter of the second ink path forming member.

19. The ink-jet printer according to claim 11, wherein the locking member extends over the outer periphery of the second ink path forming member, generally from the open end of the first ink path forming member to the maximum-diameter portion of the first ink path forming member.

20. The ink-jet printer according to claim 11, wherein the locking member extends over the outer periphery of the second ink path forming member, generally from the open end of the first ink path forming member to a middle of the neck of the first ink path forming member.

21. An ink tube for use in an ink-jet printer that has a printhead unit ejecting ink onto a printing medium and an ink source external to the printhead unit, the ink tube, through which ink is delivered from the ink source to the printhead unit, comprising:

a first layer formed of a material with low vapor and gas permeability; and a second layer radially thicker than the first layer and formed of a flexible elastic material, one of the first and second layers being an inner layer and the other being an outer layer, wherein the first layer of the ink tube is formed of a resin and the second layer of the ink tube is formed of a rubber.

22. The ink tube according to claim 21, wherein the first layer of the ink tube is formed of one of an olefin base resin and a fluorine base resin, and the second layer of the ink tube is formed of one of an olefin base elastomer, an olefin base rubber, a silicon base rubber, and a fluorine base rubber.

23. The ink tube according to claim 22, wherein the first layer of the ink tube is formed of fluorinated ethylene propylene while the second layer of the ink tube is formed of silicon rubber.

24. The ink tube according to claim 22, wherein the first layer the ink tube is formed of one of polyethylene and fluorinate ethylene propylene.

25. The ink tube according to claim 21, wherein the ink tube has an inner diameter of between about 0.8 and 2.0 mm and an outer diameter of between about 2.4 and 4.0 mm, and the first layer has a thickness of between about 60 and 80 $\mu$m while the second layer has a Shore A hardness of between about 60 and 85.

26. The ink tube according to claim 25, wherein the ink tube has an inner diameter of about 1.4 mm and an outer diameter of about 3.0 mm, and the first layer has a thickness of about 75 $\mu$m while the second layer has a Shore A hardness of about 70.

27. An ink-jet printer, comprising:

a printhead unit that ejects ink onto a printing medium;

an ink source external to the printhead unit; and an ink path through which ink is delivered from the ink source to the printhead unit, the ink path including:

a first ink path forming member having an open end;

a second ink path forming member having an open end opposed to the open end of the first ink path forming member; and a sealing member placed between the opposed open ends and sandwiched by end faces formed around openings at the open ends of the first and second ink path forming members, wherein inner peripheries of the first ink path forming member, the sealing member, and the second ink path forming member are one of flush with each other and gradually reduced in inner diameter in a direction of flow of ink.

28. The ink-jet printer according to claim 27, wherein the sealing member has a connecting portion, and one of the first and second ink path forming members has a portion fitted over an outer periphery of the other via the connecting portion.

29. The ink-jet printer according to claim 27, wherein the sealing member has a connecting portion fitted over outer peripheries of the first and second ink path forming members, and the sealing member projects radially inwardly from a substantially middle part of the connecting portion.

30. A method of forming an ink path for an ink-jet printer that has a printhead unit ejecting ink onto a printing medium and an ink source external to the printhead unit, the ink being delivered through the ink path from the ink source to the printhead unit, the method comprising the steps of:

applying a filling liquid to either an outer periphery of an open end of a first ink path forming member or an inner periphery of a second ink path forming member, wherein the first ink path forming member has a large-diameter portion larger than an inner diameter of the second ink path forming member, and the open end tapered down from the large-diameter portion and having an outer diameter smaller than the inner diameter of the second ink path forming member;

connecting the first and second ink path forming members to each other by inserting the first ink path forming member into the second ink path forming member with the filling liquid held between the outer periphery of the open end of the first forming member and the inner periphery of the second ink path forming member.

31. A method of forming an ink path for an ink-jet printer that has a printhead unit ejecting ink onto a printing medium and an ink source external to the printhead unit, the ink being delivered through the ink path from the ink source to the printhead unit, the method comprising the steps of:

connecting first and second ink path forming members by inserting the first ink path forming member into the second ink path forming member, wherein the first ink path forming member has a large-diameter portion larger than an inner diameter of the second ink path forming member, and an open end tapered down from the large-diameter portion and having an outer diameter smaller than the inner diameter of the second ink path forming member;

reducing a pressure of an inside of the connected first and second ink path forming members;

supplying a filling liquid into the inside of the connected first and second ink path forming members; and returning the pressure of the inside of the connected first and second ink path forming members to an atmospheric pressure, thereby filling a gap created between the open end of the first ink path forming member and the second ink path forming member with the filling liquid.

32. The method of forming an ink path according to claim 31, further comprising the step of previously supplying the filling liquid after the connecting step and before the pressure reducing step.

33. An ink-jet printer, comprising:

a printhead unit that ejects ink onto a printing medium;

an ink source external to the printhead unit; and an ink path through which ink is delivered from the ink source to the printhead unit, the ink path including:

an ink tube having a first layer formed of a material with low vapor and gas permeability and a second layer radially thicker than the first layer and formed of a flexible material;

a joint inserted into the ink tube and having a maximum-diameter portion whose outer diameter is larger than an inner diameter of the ink tube;

a locking member fitted over the ink tube and having an inner-diameter portion whose inner diameter is smaller than an outer diameter of a connection between the maximum-diameter portion of the joint and the ink tube, the inner-diameter portion of the locking member pressing an outer periphery of the ink tube and locking the connection.

34. The ink-jet printer according to claim 33, wherein the joint has an open end tapered down from the maximum diameter portion, and a recess extending from the maximum-diameter portion in a direction opposite to the open end and having a smaller outer diameter than the maximum-diameter portion.

35. An ink-jet printer, comprising:

a printhead unit that ejects ink onto a printing medium;

an ink source external to the printhead unit; and an ink path through which ink is delivered from the ink source to the printhead unit, the ink path including:

a first ink path forming member that has a head with a maximum-diameter portion and an open end tapered down from the maximum-diameter portion, and a neck extending from the head and having a smaller diameter than the maximum-diameter portion;

a second ink path forming member that is formed of at least a flexible elastic material and has an inner diameter smaller than the maximum diameter of the first ink path forming member, wherein the head and the neck of the first ink path forming member are inserted into the second ink path forming member, the second ink path forming member radially expanding at the maximum-diameter portion and radially contracting at the neck of the first ink path forming member, thereby establishing a connection between the first and second ink path forming members;

a third ink path forming member having an open end; wherein the first ink path forming member has an open end opposed to the open end of the third ink path forming member; and a sealing member placed between the opposed open ends and sandwiched by end faces formed around openings at the open ends of the third and first ink path forming members, the inner peripheries of the third ink path forming member, the sealing member, and the first ink path forming member are one of flush with each other and gradually reduced in inner diameter in a direction of flow of ink, wherein the second ink path forming member is an ink tube, comprising:

a first layer formed of a material with low vapor and gas permeability; and a second layer radially thicker than the first layer and formed of a flexible material, one of the first and second layers being an inner layer and the other being an outer layer.

* * * * *